United States Patent [19]

Sucato

[11] Patent Number: 4,550,848

[45] Date of Patent: Nov. 5, 1985

[54] BAFFLE FOR CANTEENS TO PREVENT LIQUID SPLASHING SOUNDS

[76] Inventor: Edward Sucato, 3102 N. 24th St., Phoenix, Ariz. 85016

[21] Appl. No.: 609,304

[22] Filed: May 11, 1984

[51] Int. Cl.[4] ..... B65D 1/04; B65D 5/48; B65D 25/04

[52] U.S. Cl. ..... 220/22; 215/6; 229/15

[58] Field of Search ..... 220/20, 22, 22.1, 22.2, 220/22.3; 215/6; 229/15

[56] References Cited

U.S. PATENT DOCUMENTS 2,362,354 11/1944 Clovis .
2,428,056 9/1947 Wachsman .
3,064,872 11/1962 Skirow ..... 229/15
3,139,229 6/1964 De Pasquale ..... 220/22
3,400,855 9/1968 Alexander .
4,272,768 6/1981 Rookard ..... 215/6

FOREIGN PATENT DOCUMENTS 174217 7/1971 Sweden .

*Primary Examiner*—George E. Lowrance
*Attorney, Agent, or Firm*—Warren F. B. Lindsley

[57] ABSTRACT

An elongated baffle having a plurality of apertured damping members connected together to extend radially outwardly of its center which members are coilable so that the baffle can fit through the neck of a canteen with the members then expanding in the canteen to prevent liquid splashing sounds.

4 Claims, 5 Drawing Figures

BAFFLE FOR CANTEENS TO PREVENT LIQUID SPLASHING SOUNDS

BACKGROUND OF THE INVENTION

This invention relates to canteens, and more particularly to baffles for use in the well known, usually cloth jacketed, flasks developed for carrying water or other liquid by soldiers, hikers, hunters, campers, and the like.

DESCRIPTION OF THE PRIOR ART

Although baffles have been known for cups, water beds and carrying bags, none are known that can be built into, or later inserted into, a canteen. Since it is absolutely necessary that water splashing sounds be eliminated from the canteens of the military, hunters, and the like, for noise elimination reasons, a new and improved baffle structure is provided that may be readily inserted into the canteen for soundproofing purposes without restricting the normal use of the canteen.

U.S. Pat. No. 2,362,354 discloses a splash dampener for beverage containers wherein the damping elements are formed of flexible sheet material which may be inserted in a container having a relatively small opening. The damping elements have a greater length than the diameter of the container causing them to be retained in a flexed or bowed condition.

U.S. Pat. No. 2,428,056 discloses a drinking cup having wing-type baffle members which are inserted into the cup, frictionally engaging the inner side walls. The wing members are glued together at a central point and may be collapsible.

U.S. Pat. No. 3,400,855 discloses a splash dampener utilizing a perforated baffle member.

Swedish Pat. No. 174,217 discloses a container having a series of perforated baffles for use in preventing sloshing of the contents in a bag-like container.

SUMMARY OF THE INVENTION

In accordance with the invention claimed, a new and improved baffle for canteens or the like is provided which is insertable into the canteen at the time of manufacture or later for eliminating or substantially reducing splashing and the sound produced thereby of the liquid in the container.

It is, therefore, one object of this invention to provide a new and improved baffle for canteens and the like.

Another object of this invention is to provide a new and improved flexible and expandable apertured baffle for flasks, such as canteens and the like, which may be rolled or coiled to a size small enough to pass through the neck of the flask and then expanded to its operable size when inside of the flask.

A further object of this invention is to provide a new and improved canteen employing a built-in baffle for preventing splashing of its liquid contents and the sounds attributable thereto.

A still further object of this invention is to provide a relatively inexpensively manufactured baffle structure which may be readily inserted with a minimum of effort into canteens already existing in the marketplace.

Further objects and advantages of the invention will become apparent as the following descriptions proceeds and the features of novelty which characterize the invention will be pointed out with particularity in the claims annexed to and forming a part of this specification.

BRIEF DESCRIPTION OF THE DRAWING

The present invention may be more readily described by reference to the accompanying drawing, in which.

DESCRIPTION OF THE PREFERRED EMBODIMENT

Figure 1:
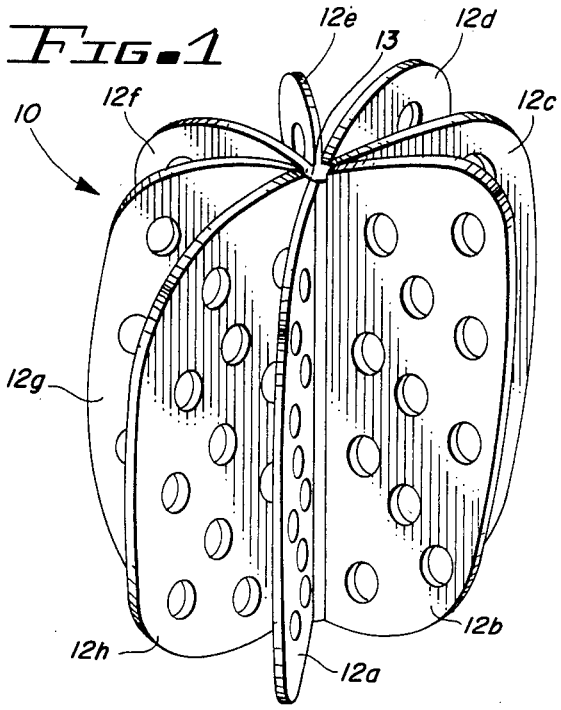
FIG. 1 is a perspective view of an illustrative embodiment of one form of baffle for insertion into a flask such as a canteen or the like and embodying the invention.
Figure 2:
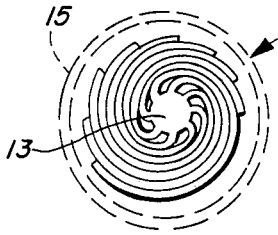
FIG. 2 is a top view of the baffle shown in FIG. 1 when coiled or rolled up for insertion through the neck of the canteen shown in FIG. 3.
Figure 3:
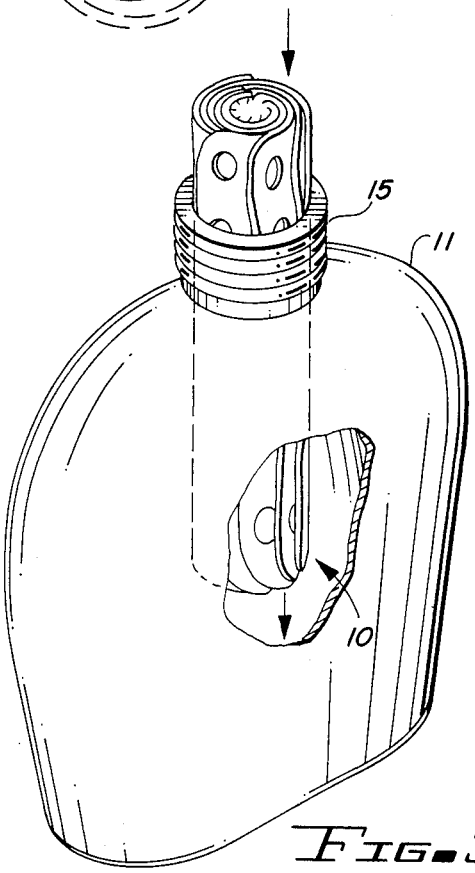
FIG. 3 is a perspective view, partially broken away, of a canteen showing the baffle of FIGS. 1 and 2 in coiled form being inserted through the neck of the canteen into its interior.
Figure 4:
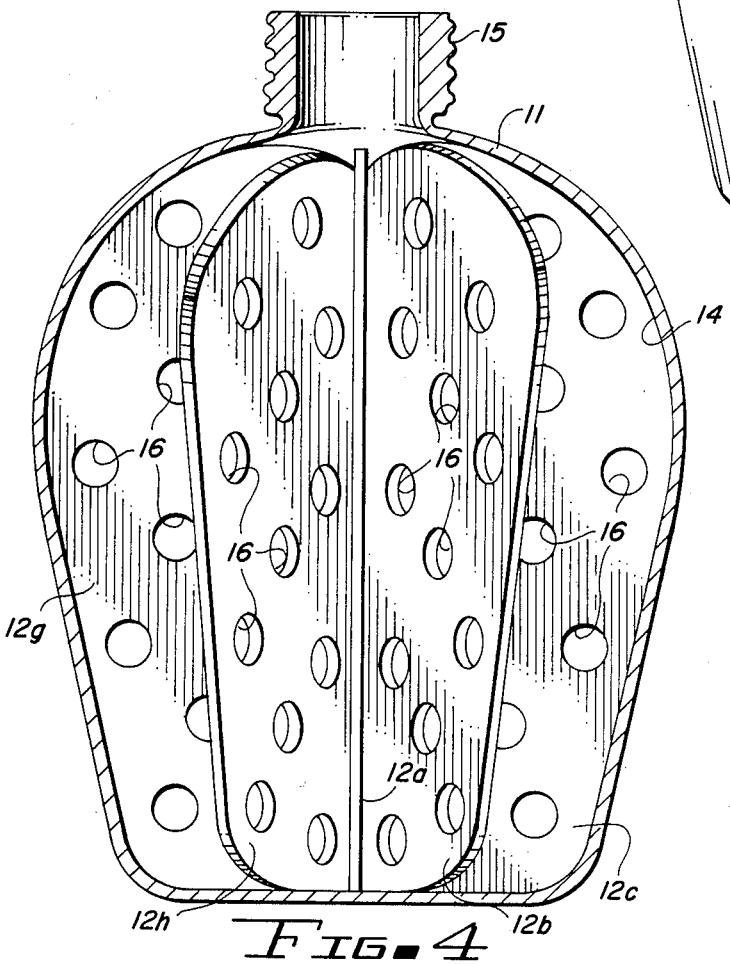
FIG. 4 is a cross-sectional view of the canteen shown in FIG. 3 with the baffle inside thereof in fully extended position.

Referring more particularly to the drawing by characters of reference, FIGS. 1 and 2 dislose a damping insert or baffle 10 for positioning in a flask such as, for example, a canteen 11 shown in FIG. 3 to substantially reduce or eliminate splashing of its liquid contents when moved. This baffle preferably is constructed and arranged to provide a plurality of wing-shaped damping members 12*a*–12*h* which extend radially outwardly from a center core member 13 of the baffle and the center of the canteen when the baffle is inserted therein. The outer edges of the damping members abut with the inner surface 14 of the canteen when the baffle is positioned in the canteen, as shown in FIG. 4.

These damping members may be spacedly secured to and around core member 13 in any suitable manner so as to extend radially outwardly thereof with the height and width of the damping members and the number thereof being varied depending upon the size and shape of the container and violence of the shock to which the container may be subjected to so long as the damping members provide the desired damping effect.

The baffle, including its damping and core members, may be formed, for example, of plastic selected to have the stiffeners to remain in the extended position once unfolded and expanded, but have enough resiliency so as to roll or fold up, as shown in FIGS. 2 and 3, so that the baffle may be readily inserted through the neck 15 of a container, such as canteen 11, shown in FIG. 3.

It should be noted that the periphery of the damping members 12*a*–12*h* should conform to that of the interior configuration of the canteen. Apertures 16 are randomly provided in one or more of the damping members to equalize the volumn of the liquid in the canteen and to permit the temperature of the liquid to be evenly distributed.

Figure 5:
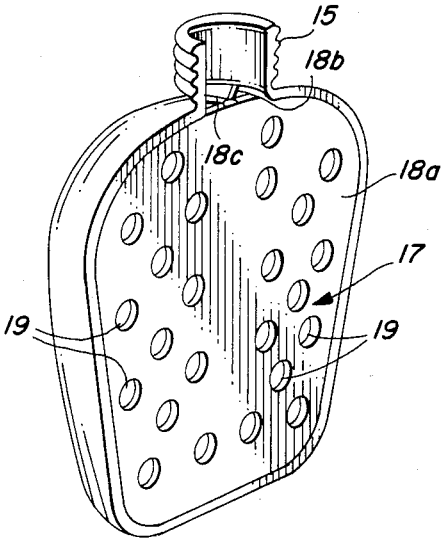
FIG. 5 is a partial perspective view of a modification of the baffle and canteen configuration shown in FIGS. 1–4.

FIG. 5 illustrates a modification of the interior of canteen 11 wherein a rigid baffle 17 comprising one or more damping members 18*a*–18*c* are fixedly built into the canteen at the time of its manufacture. In this instance the core member 13 of the baffle 10 structural arrangement of FIGS. 1–4 is not needed. The damping members are provided with randomly spaced apertures 19 for the purposes heretofore described.

Although but a few embodiments of the invention have been illustrated and described, it will be apparent to those skilled in the art that various changes and modifications may be made therein without departing from the spirit of the invention or from the scope of the appended claims.

What is claimed is:

1. An elongated baffle for canteens to prevent liquid splashing sounds comprising:

a plurality of damping members connected together to extend radially outwardly of the center of the baffle and all arranged longitudinal of its length, at least one of said damping members being provided with at least one aperture for providing liquid flow therethrough, said damping members being formed of a resilient plastic material which members may be coiled in the same direction around the center of the baffle so that the coiled baffle may be inserted through the neck of a canteen and into its interior wherein the damping members uncoil with their edges frictionally engaging the inside walls of the canteen in a spaced arrangement.

2. The elongated baffle set forth in claim 1 wherein:

each of said damping members is provided with a plurality of apertures randomly positioned in the damping member.

3. A canteen comprising:

a hollow container having a narrow neck for receiving and discharging liquid, an elongated baffle axially positioned in said container, said baffle comprising a plurality of damping members formed of a resilient plastic material connected together to extend radially outwardly of the center of the baffle and all arranged longitudinally of said container, and at least one of said damping members being provided with at least one aperture for providing liquid flow therethrough, the peripheral edges of said damping members frictionally engaging the inside walls of the container in a spaced arrangement.

4. The canteen set forth in claim 3 wherein:

each of said damping members is provided with a plurality of randomly positioned apertures extending therethrough for forming liquid flow passageways.

* * * * *